United States Patent [19]

Sterns et al.

[11] Patent Number: 4,814,780

[45] Date of Patent: Mar. 21, 1989

[54] VARIABLE DIRECTIONAL COUPLER

[75] Inventors: William G. Sterns, Los Angeles; Ching-Fai Cho, Tujunga, both of Calif.

[73] Assignee: ITT Gilfillan, a division of ITT Corporation, Van Nuys, Calif.

[21] Appl. No.: 167,288

[22] Filed: Mar. 11, 1988

[51] Int. Cl.[4] ..... H01Q 19/00; H01P 5/04; H01P 5/18

[52] U.S. Cl. ..... 343/756; 333/111; 333/115

[58] Field of Search ..... 333/109, 111, 113, 114, 333/115, 116, 117, 123, 263; 343/756

[56] References Cited

U.S. PATENT DOCUMENTS

| | | | |
|---|---|---|---|
| 3,059,186 | 10/1962 | Allen | 333/117 X |
| 3,359,513 | 12/1967 | Kelley | 333/263 X |
| 3,659,227 | 9/1970 | Whistler | 333/109 X |
| 4,697,160 | 9/1987 | Clark | 333/116 X |

*Primary Examiner*—Paul Gensler

*Attorney, Agent, or Firm*—Robert A. Walsh; Thomas N. Twomey; Mary C. Werner

[57] ABSTRACT

The variable directional coupler of the subject invention employs 3, 4 or n branches in TEM transmission media, such as coax, stripline and microstrip. Precise control of the coupling is acheived by a variable susceptance connected near the mid-point of the crossover.

8 Claims, 8 Drawing Sheets

Fig. 1.
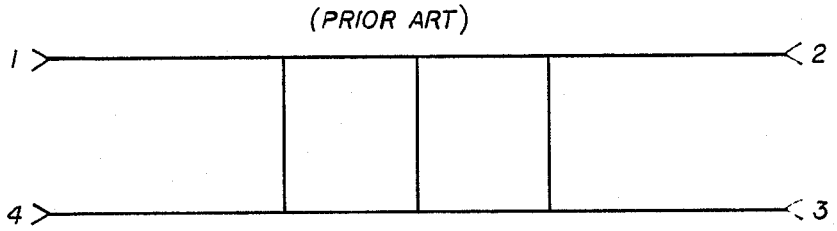
Fig. 2.
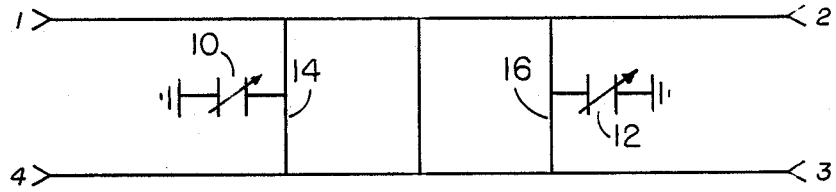
Fig. 3.
FIG. 3a
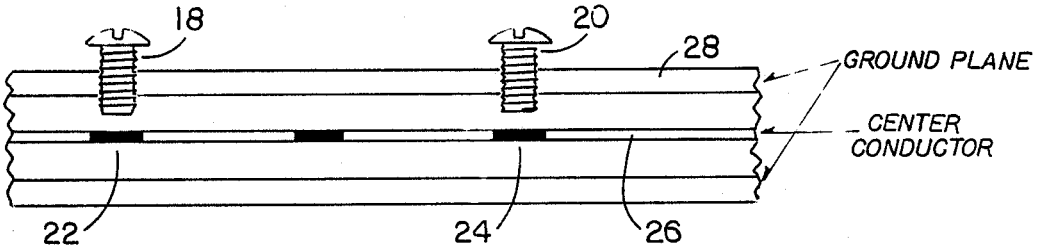
FIG 3b
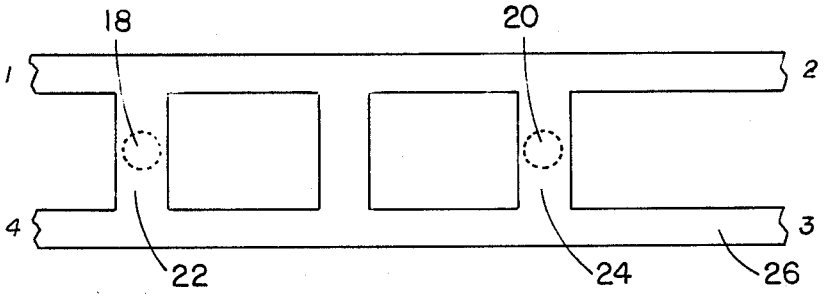

Fig. 5.
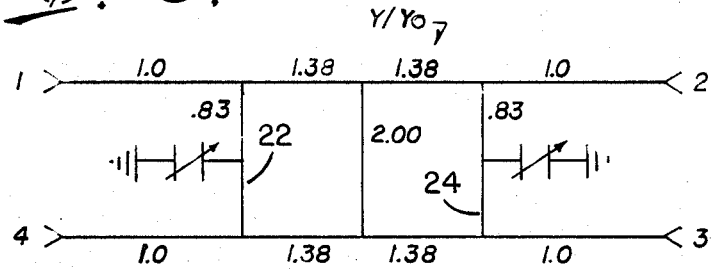
FIG 5a
—— C=0
- - - Bc=.03 (fo)
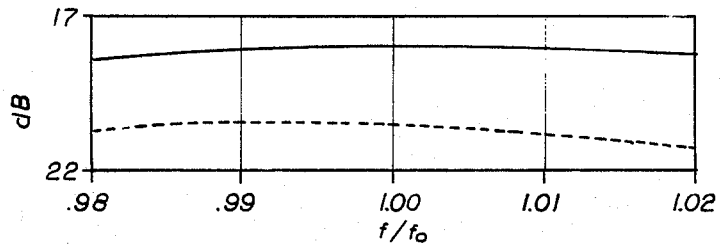
FIG 5b
COUPLING
1-2
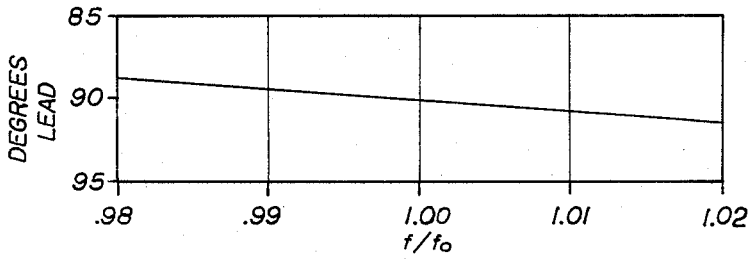
FIG 5c
PHASE
2 wrt 3
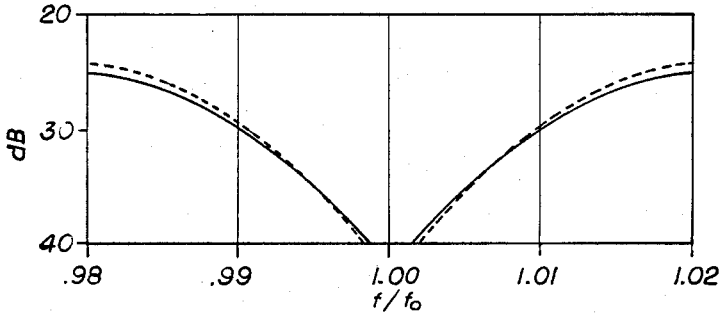
FIG 5d
ISOLATION
1-4
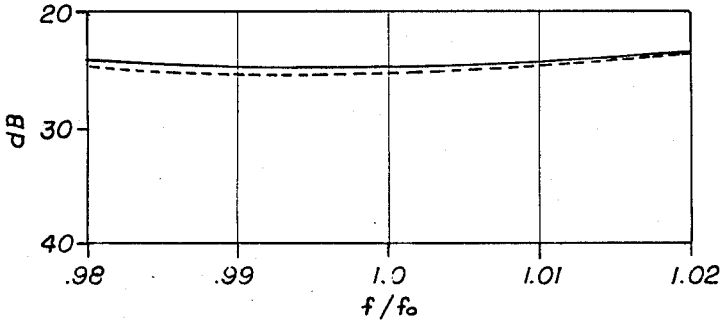
FIG 5e
RETURN LOSS Fig. 6.
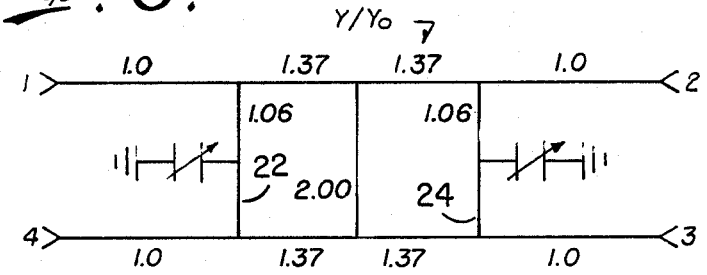
FIG. 6a
—— C = 0
---- Bc = .04 (fo)
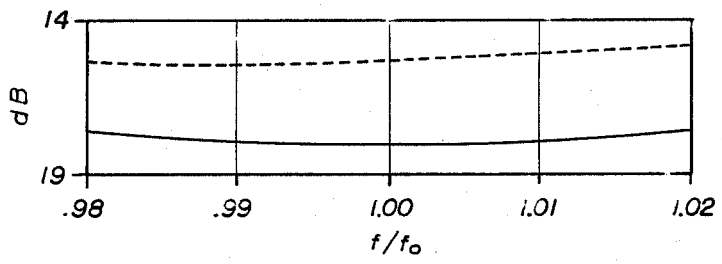
FIG. 6b
COUPLING
1-2
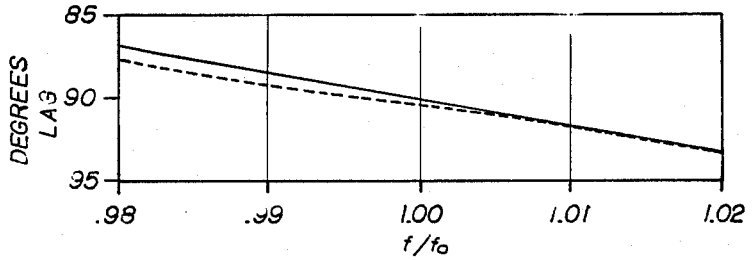
FIG. 6c
PHASE
2 wrt 3
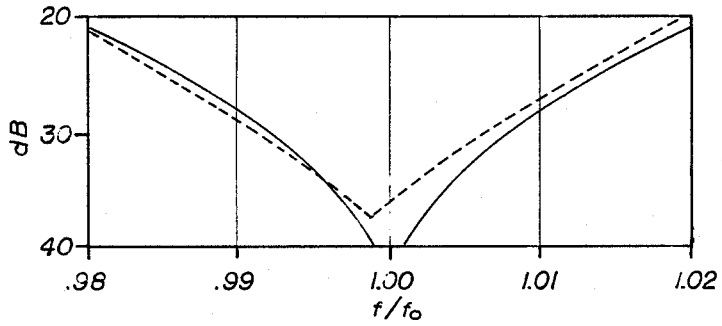
FIG. 6d
ISOLATION
1-4
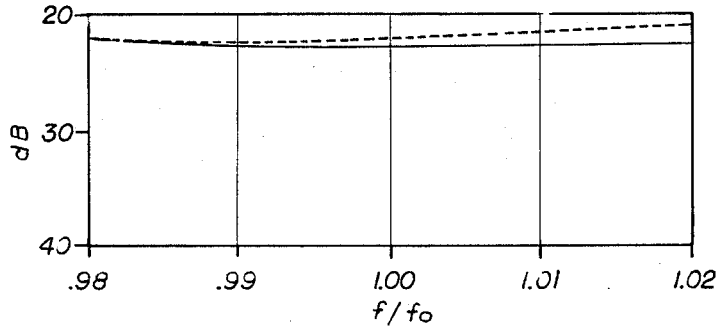
FIG. 6e
RETURN LOSS Fig. 7.
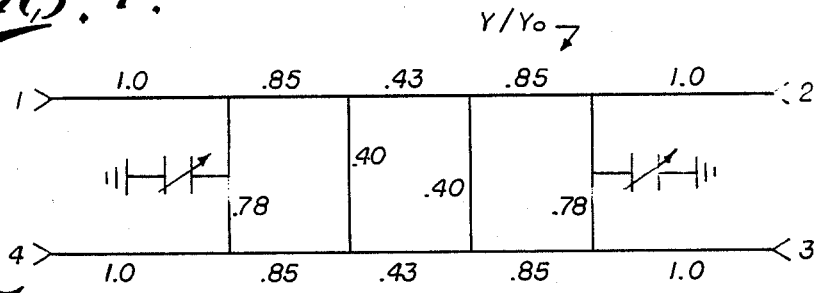
Fig. 8.
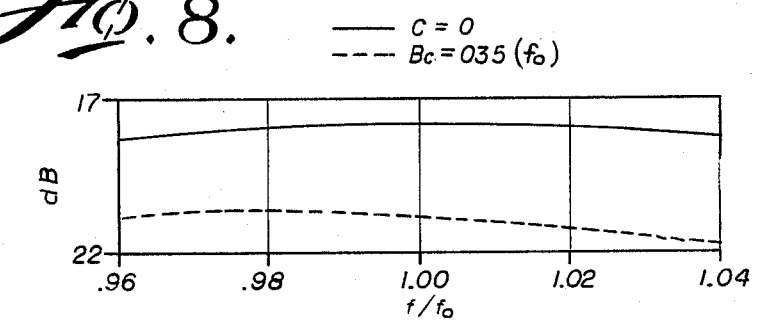
FIG 8a
COUPLING 1-2
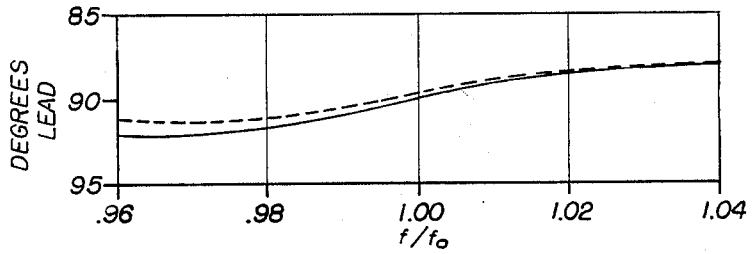
FIG 8b
PHASE 2 wrt 3
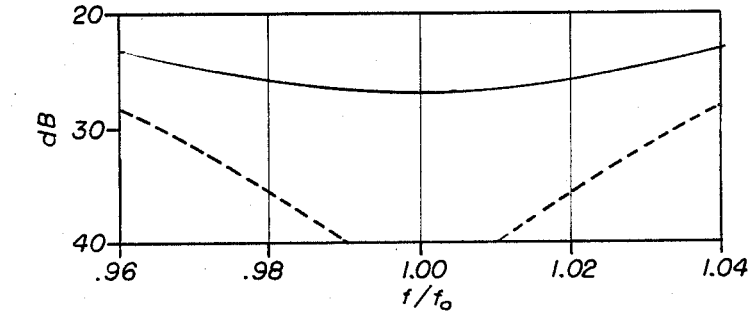
FIG 8c
ISOLATION 1-4
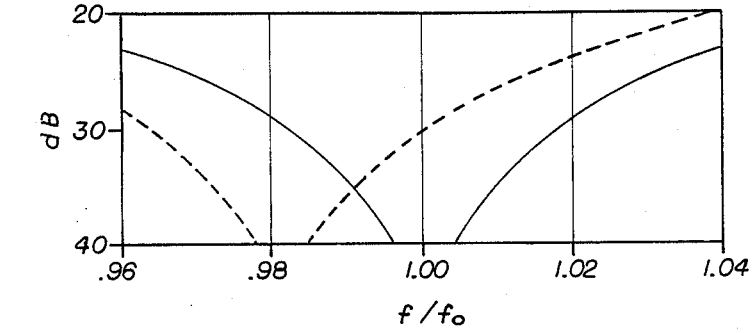
FIG 8d
RETURN LOSS Fig. 9.
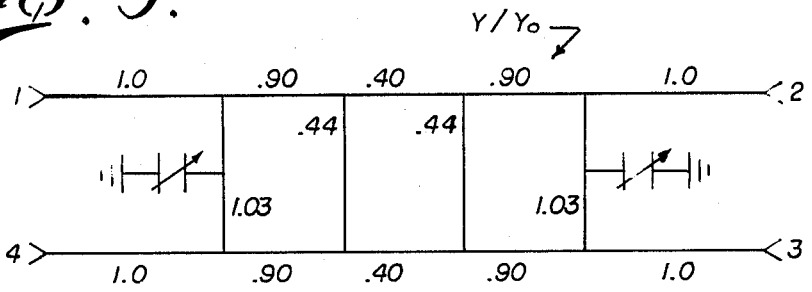
Fig. 10.
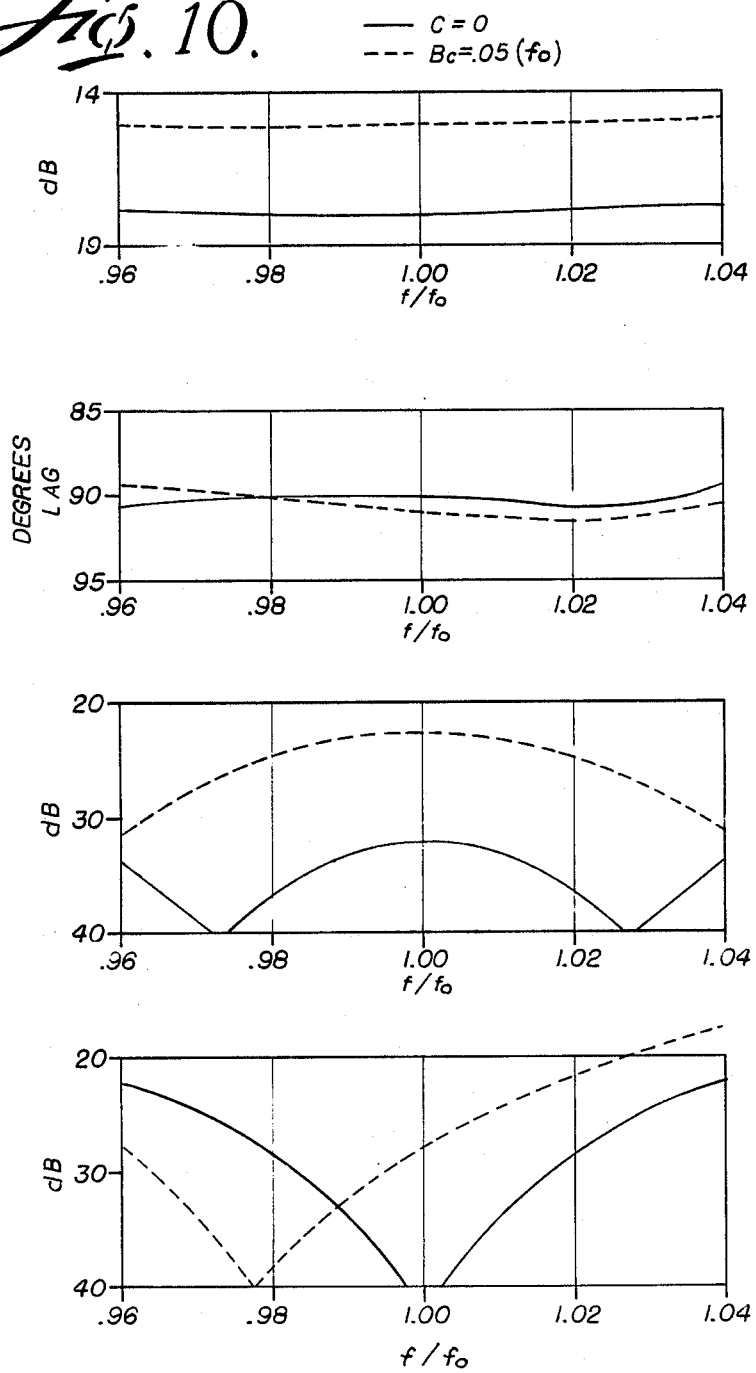
FIG 10a
COUPLING 1-2
FIG 10b
PHASE 2 wrt 3
FIG 10c
ISOLATION 1-4
FIG 10d
RETURN LOSS

VARIABLE DIRECTIONAL COUPLER

BACKGROUND OF THE INVENTION

1. Field of the Invention

The subject invention relates generally to directional couplers, and more particularly to variable couplers for use in microwave frequency bands.

2. Description of the Prior Art

Variable coaxial directional couplers have existed for many years. A typical unit is the HP-393A as set out in the 1969 Hewlett-Packard catalog. This coaxial variable attenuator uses a principle of a directional coupler to achieve a wide range of attenuation over a full octave. The 393A covers 5 to 120 dB from 500 to 1,000 MHz. With special high power terminations it will handle up to 200 watts average, and is useful for mixing signals while maintaining isolation. Its intended use, however, is entirely different from that of the invention. It was designed for laboratory test bench applications. Variable coupling is achieved by mechanically adjusting the physical separation of the auxiliary coupled transmission line from the main through line. Such a device could not readily be incorporated into a multi-port microwave distribution network.

U.S. Pat. No. 4,697,160, Clark, discloses a hybrid power combiner and amplitude controller, which either couples or not, in distinction from the subject invention which sets at one or more values and fine tunes with a capacitor or other susceptance. When a transmission line element is used as the variable susceptance the coupling is frequency dependent.

U.S. Pat. No. 4,433,313, Saint et al., discloses a microwave directional coupler for coupling between a waveguide and stripline in which capacitors and inductors are used to equalize the phase velocity in the two media, which is required for flat, constant coupling versus frequency and good directivity.

SUMMARY OF THE PRESENT INVENTION

The general object of the present invention is to provide a variable directional coupler with 3, 4 or n branches in TEM transmission media such as coax, stripline and microstrip, wherein precise control is achieved by adjustable susceptances which are connected near the midpoint of the crossover for fine tuning. The intended use of the invention is in an antenna feed system, such as described in U.S. Pat. No. 4,764,771 issued Aug. 16, 1988 entitled Antenna Feed Network Employing Over-Coupled Branch Line Couplers (Sterns 5), assigned to the assignee of the present invention. The range of coupling adjustment is limited, but is sufficient to compensate for manufacturing tolerances of feed systems and effects of mutual coupling between radiators in an array. It is intended that the coupling be adjusted during system tests, and then locked in to provide a permanent setting.

The details of typical implementation are presented hereinafter.

BRIEF DESCRIPTION OF THE DRAWINGS

FIG. 1 is a schematic of the directional couplers of the prior art;

FIG. 2 is a schematic of the variable directional coupler of the present invention;

FIGS. 3*a* and 3*b* are schematics of a 3 branch coupler, wherein the variable capacity is achieved by tuning screws over the outer lines, 3*a* being a side view and 3*b* a top view;

FIGS. 5*a*–5*e* illustrate the theoretical performance of a coupler such as illustrated in FIG. 2, wherein the phase of Port 2 leads Port 3 and increasing capacity decrease coupling; (Type 1);

FIGS. 6*a*–6*e* illustrate the theoretical performance of a 3 branch coupler such as illustrated in FIG. 2, wherein the phase of Port 2 lags Port 3 and increasing capacity increases coupling; (Type 2);

FIG. 7 illustrates a 4 branch Type 1 coupler;

FIGS. 8*a*–8*d* illustrate the performance of the 4 branch Type 1 coupler of FIG. 7 in which the phase of Port 2 leads Port 3;

FIG. 9 illustrates a 4 branch Type 2 coupler;

FIGS. 10*a*–10*d* illustrate the performance of the 4 branch Type 2 coupler of FIG. 9 in which the phase of Port 2 lags Port 3;

DETAILED DESCRIPTION OF THE PREFERRED EMBODIMENT

Figure 4:
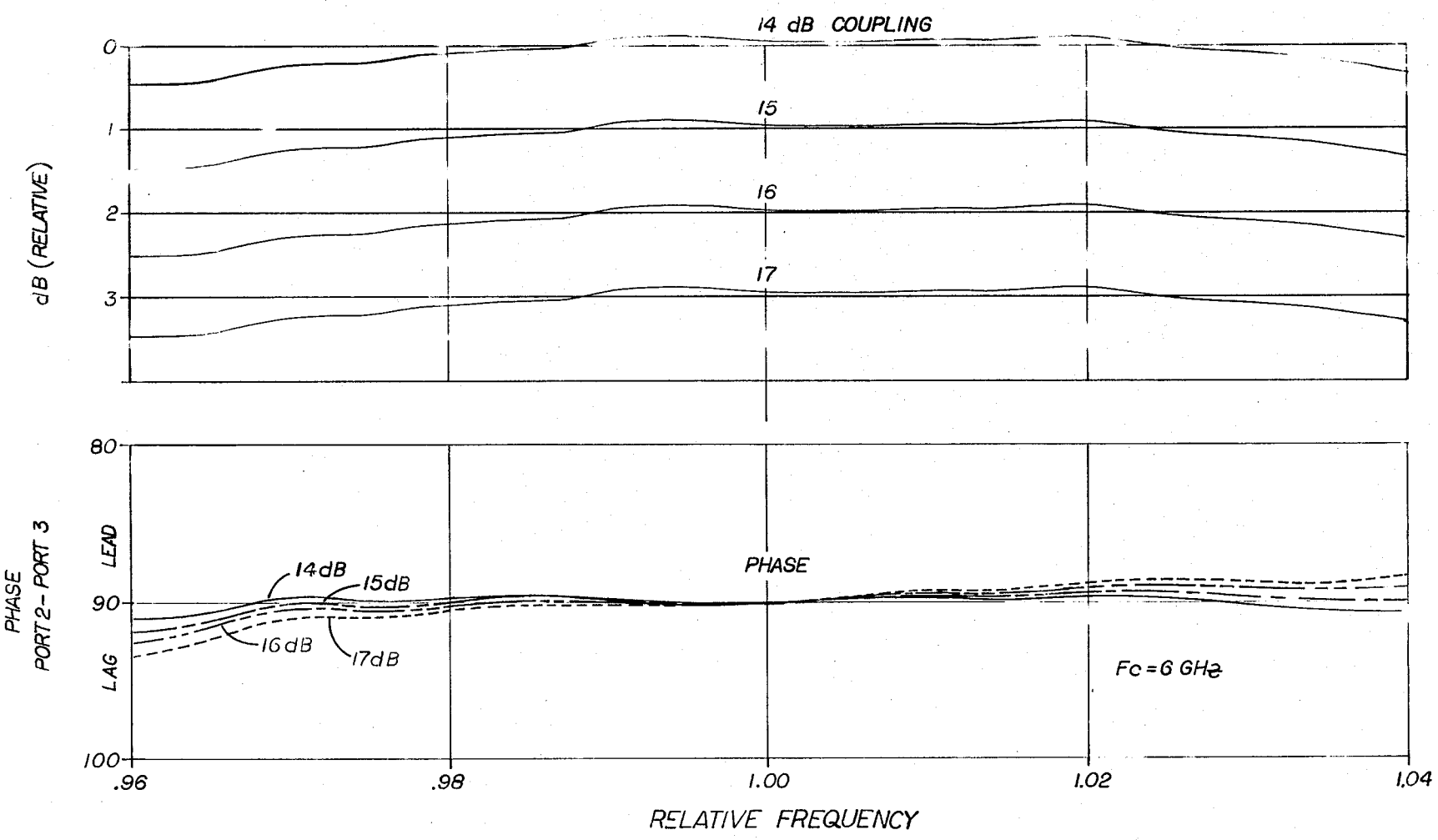
FIGS. 4*a* and 4*b* are graphs of experimental data on the coupler of FIG. 3 illustrating coupling as a function of frequency in FIG. 4*a*, and the essentially invariant phase with coupling in FIG. 4*b*.

Turning now to the drawings wherein there is disclosed a novel microwave directional coupler which is realizable in TEM transmission media, such as coax, stripline and microstrip, wherein the coupled power level can be easily and conveniently adjusted, with negligible effect on insertion phase, isolation or return loss. The coupler of the present invention is a derivative of the common familiar branch-line directional couplers, such as illustrated in FIG. 1, labeled prior art. Referring to FIG. 1, in common usage most of the power fed into Port 1 exits at Port 2 with a fraction of the power exiting at Port 3, Port 4 being isolated. Coupling values (the power ratio P3/P1) are generally limited by achievable transmission line characteristic impedances of 3 dB to 10 dB. Similar circuit elements have been described when most of the power fed into Port 1 appears at Port 3, with an arbitrarily less amount of power appearing at Port 2, with Port 4 again isolated. This latter configuration is employed in a patent entitled "Antenna Feed Network Employing OverCoupled Branch Line Couplers", U.S. Pat. No. 4,764,771 issued Aug. 16, 1988, Sterns, and assigned to the assignee of the present invention. This type of coupler is referred to as a crossover coupler. In either the common or crossover form, coupling accuracy is limited by manufacturing tolerances. For a 3 dB common type, ±0.1 dB is expensive to realize. For a 10 dB coupler, accuracy is generally limited to ±0.5 dB. This is not good enough for a precision distribution network.

The essence of the present invention is a method of controlling or adjusting the coupling of a crossover coupler. This is accomplished by placing a variable susceptance, such as the capacitors 10 and 12 of FIG. 2, on the central points of the outboard coupler arms 14 and 16, respectively. Variable inductances may be used, but variable capacities are easier to realize in a microwave circuit. If the crossover coupler is of the type wherein the phase of Port 2 leads Port 3 (Type 1), increasing capacity decreases coupling. If Port 2 lags Port 3, increasing capacity increases coupling (Type 2).

FIG. 3*a* and 3*b* are a side view and a top view, respectively, of a 3 branch coupler wherein the variable capacity is achieved by tuning screws 18 and 20 over the outer lines 22 and 24, respectively, of the center conductor 26, the tuning screws being mounted in the ground plane 28.

The nominal coupling of this Type 1 coupler is 14 dB. As capacitance is added to the outer branches of the coupler by lowering the screws 18 and 20, the coupling is decreased. FIG. 4*a* illustrates the variation of coupling as a function of frequency when the midband coupling is adjusted to 14, 15, 16 and 17 dB as shown. It can be seen that there is very little change in the peak-to-peak variation of the coupling over 8% frequency band. FIG. 4*b* is a variation in relative phase between Port 2 and Port 3 as a function of frequency when the midband frequency is adjusted from 14 to 17 dB. It can be seen that the peak-to-peak variation in relative phase changes from 1.2° to 6.5° over the 8% frequency band. The return loss of the coupler was also measured and found to be below 26 dB over the 8% band for the nominal 14 dB coupling. When the coupling was adjusted from 14 to 17 dB, the return loss was actually found to be lower in the same frequency band.

The theoretical performance of Type 1 and Type 2 of the 3 branch couplers is shown in FIGS. 5*a*–5*e* and 6*a*–6*e*, respectively. In both figures, the nominal coupling at midband is 18 dB. The admittances of the branch-lines 22 and 24 can be varied between the values 0.4 and 2.0 which are practically realizable values in stripline, such that both the return loss and isolation are below 20 dB over a 4% frequency band. The numbers in FIGS. 5*a* and 6*a* between the ports and branch lines and next to the branch lines are Y/Yo or the conductances of the various lines used in the examples. This is also true of FIGS. 9 and 13. The results for the coupling, relative phase with respect to (wrt) Ports 2 and 3, isolation, and return loss are shown as solid curves in FIGS. 5*b*–5*e* and 6*b*–6*e* respectively. Capacitance is then added to the outer branches of the coupler to change the coupling by about 3 dB. The change in coupling, relative phase between Ports 2 and 3, isolation, and return loss are shown as dashed curves in FIGS. 5 and 6.

It can be seen that for an 18 dB coupler, one can vary the coupling over 3 dB without significantly degrading the performance of the coupler over 4% frequency band.

The bandwidths of the couplers can be significantly increased by adding a fourth branch, such as illustrated in FIGS. 7 and 9. The theoretical performance of Type 1 and Type 2 couplers of the 4 branch variety is shown in FIGS. 8*a*–8*d*, and 10*a*–10*d* respectively, with coupling, phase, isolation and return loss shown in FIGS. 8 and 10 *a, b, c,* and *d,* respectively. It is seen that performance similar to that of the 3 branch coupler shown in FIGS. 5 and 6 can be increased to cover an 8% frequency band for the 4 branch coupler of FIGS. 7 and 9. In general, the bandwidth performance of this type of coupler is expected to increase as the number of branches increases.

Figure 11:
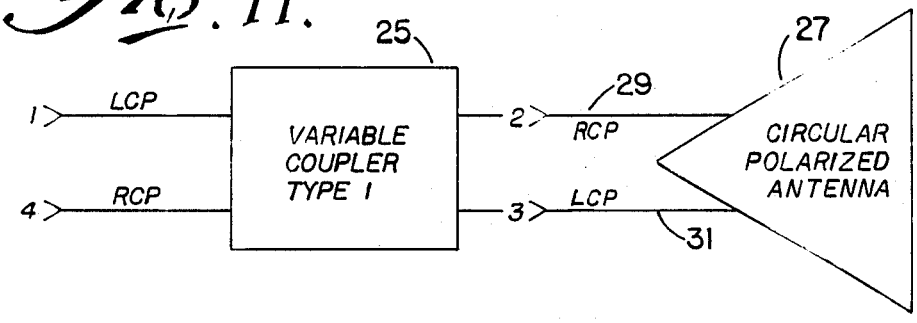
FIG. 11 is a schematic of a network similar to FIG. 2 used in conjunction with a dual circularly polarized array antenna to correct for polarization impurities caused by different mutual couplings of the two polarizations.
Figure 12:
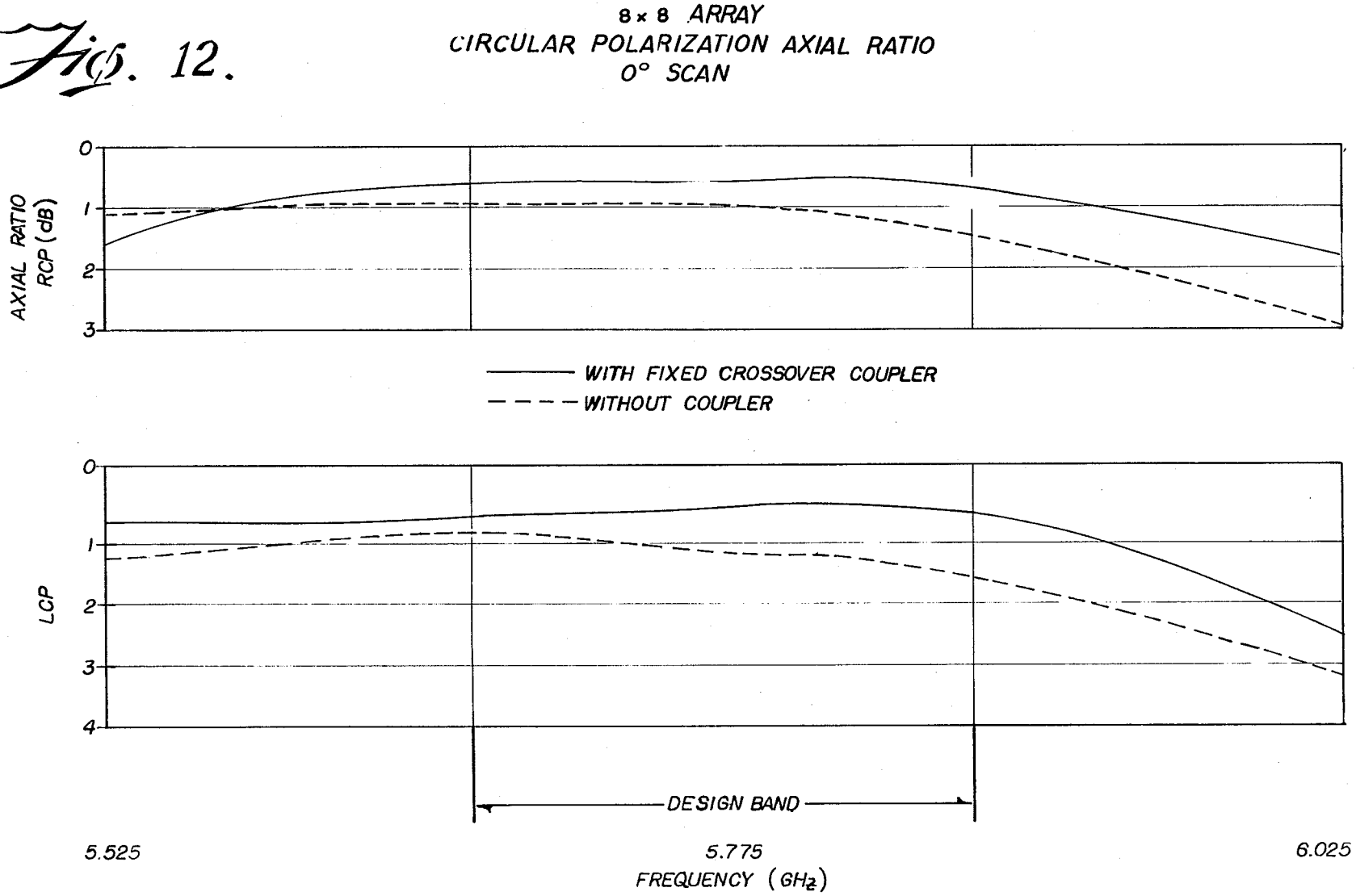
FIG. 12 is a graph of the circular polarization axial ratio versus frequency with and without fixed crossover couplers illustrating, in FIG. 12*a*, right-hand circular polarization and in FIG. 12*b*, left-hand circular polarization of a radiator with horizontally polarized elements and vertical polarized elements excited in quadrature.

FIG. 11 illustrates a cross-coupling network 25, such as shown in FIG. 2, used in conjunction with a dual polarized array antenna 27 to correct for polarization impurities caused by the different mutual couplings of the two polarizations. Left hand circular polarization (LCP) is present at ports 1 and 3 of coupler 25 and right hand circular polarization (RCP) at ports 2 and 4. In a dual polarized antenna array, the mutual coupling is different for horizontally and vertically polarized radiators. If the individual isolated elements radiate pure polarization, the array will not be pure polarized. By connecting the variable coupler to the two antenna input ports 29 and 31, a cancelling signal can be introduced to improve the radiated polarization. FIG. 12 illustrates the right-hand circular polarization (RCP) and left-hand circular polarization (LCP) axial ratios of a radiator with horizontally polarized elements and vertically polarized elements excited in quadrature plotted as a function frequency. The dashed curves show the axial ratio when the horizontally polarized elements and the vertically polarized elements are excited with equal amplitudes. The solid curves show the axial ratio of the same radiator when a fixed branch-line coupler is used to excite the horizontally polarized elements and the vertically polarized elements with slightly different amplitudes. From the behavior of the solid and dashed curves one can conclude that with a variable coupler in accordance with this invention near-perfect polarization may be achieved. If the fixed crossover coupler, which had a coupling value of 21.5 dB, used to obtain the data of FIG. 12 was replaced with a variable coupler in accord with this invention, and the coupling was adjusted to 23.5 dB, near-perfect circularity would result at midband, with improved circularity over the entire band.

Figure 13:
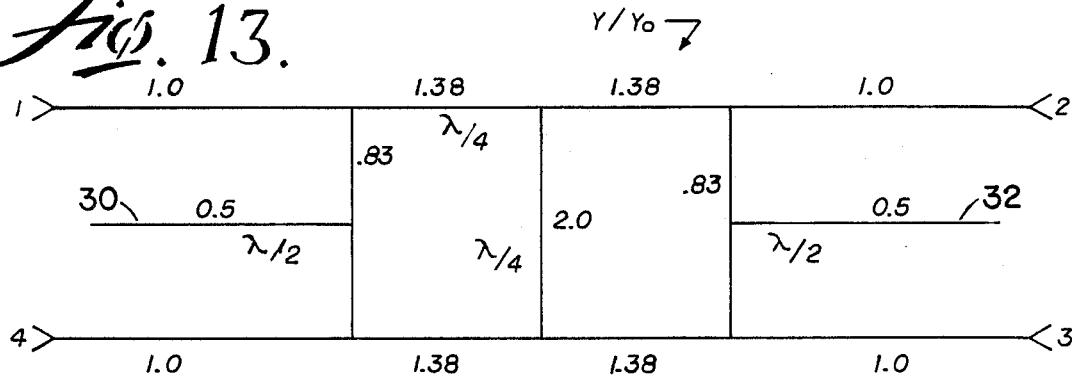
FIG. 13 is a schematic of a variable directional coupler such as in FIG. 2 in which the capacitive susceptances are replaced by half wavelength open stubs.
Figure 14:
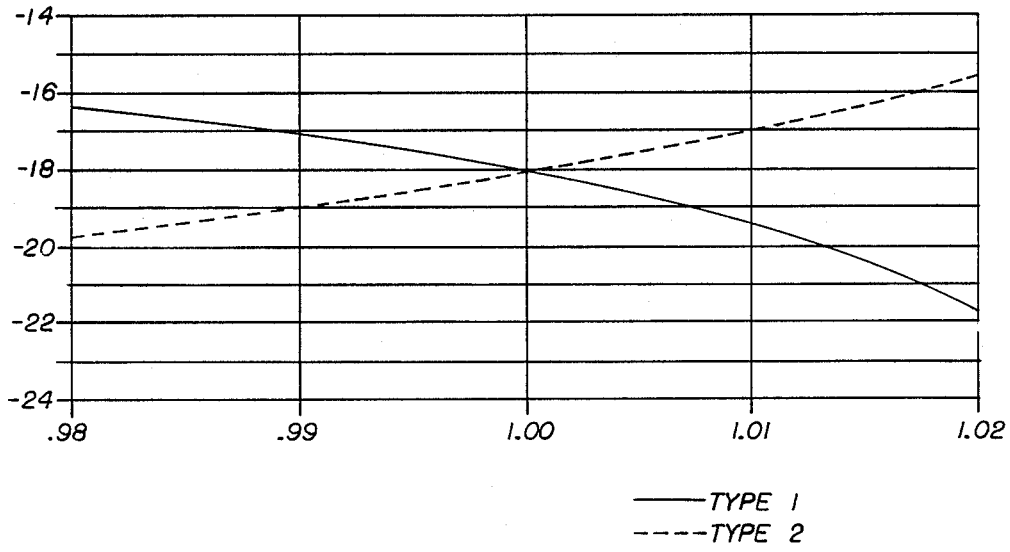
FIG. 14 is a graph of the performance of the coupler of FIG. 13 in which the solid line shows the variation in the coupling for a Type 1 coupler wherein the phase of Port 2 leads Port 3, and the dashed line the variation of a Type 2 coupler wherein the phase of Port 2 lags Port 3.

FIG. 13 illustrates a variable directional coupler such as disclosed in FIG. 2 in which half-wave open stubs 30 and 32 replace capacitors 10 and 12, respectively, illustrating the manner in which a frequency sensitive coupler can be realized in an application such as for equalizing networks or simple discriminators or dual polarized antennas. FIG. 14 illustrates the variation in coupling with frequency, the solid line being for a Type 1 and the dotted line a Type 2 coupler of a type shown in FIG. 12. The coupling varies from 16.2 dB at $f/f_c=0.98$ to 21.5 dB at $f/f_c=1.02$ for the Type 1 coupler. Using the same half wavelength lines in the Type 2 coupler, the coupling is shown to vary from 19.9 dB at $f/f_c=0.98$ to 15.5 dB at $f/f_c=1.02$. If the half-wave open lines are replaced with a shorted quarter-wave line, the coupling variations reduce to 2.2 dB. If the $Y_o$ of the stubs is decreased, the coupling variation decreases; conversely, if $Y_o$ is increased, the variation increases. If the variable coupler shown in FIG. 11 was replaced with a Type 1 coupler as shown in FIG. 13, and the coupling adjusted to be 26 dB at the low end of the band and 20 dB at the high end of the band, near-perfect circularity would result over the entire band.

From the foregoing description of the invention, various modifications within th scope and spirit of the invention will suggest themselves to those skilled in the art. Accordingly, it is not intended that the scope of the invention should be regarded as limited by the drawings or the specifics of the description, these being intended to be typical and illustrative only.

What is claimed as new and desired to be secured by Letters Patent of the United States is:

1. A variable directional coupler in TEM transmission media such as coax, stripline or microstrip having two parallel transmission lines containing input, output, coupled and isolated ports and having at least three branches connected therebetween including first and last branches wherein continuously adjustable susceptances are connected from near the midpoints of said first and last branches to ground in order to precisely control coupling.

2. The coupler of claim 1 in which said adjustable susceptances are capacitors.

3. The coupler of claim 1 in which said adjustable susceptances are varactor diodes in order to provide electronic control of the coupling.

4. The coupler of claim 1 in which said adjustable susceptances are reactively terminated transmission-line sections for producing a frequency-sensitive coupler having exact control of either a positive or negative amplitude slope with frequency.

5. In combination: a variable directional coupler in TEM transmission media such as coax, stripline or microstrip having two parallel transmission lines containing input, output, coupled and isolated ports and having at least three branches connected therebetween including first and last branches wherein continuously adjustable susceptances are connected from near the midpoints of said first and last branches to ground in order to precisely control coupling and a dual polarized array antenna having dual inputs connected to said output and coupled ports in order to correct for polarization impurities caused by the different mutual couplings of the two polarizations.

6. The coupler of claim 5 in which said adjustable susceptances are reactively terminated transmission line sections for producing a frequency-sensitive coupler having exact control of either a positive or negative amplitude slope with frequency.

7. In combination: a variable directional coupler in TEM transmission media such as coax, stripline or microstrip having two parallel transmission lines containing input, output, coupled and isolated ports and having at least three branches connected therebetween, including first and last branches wherein continuously adjustable susceptances are connected from near the midpoints of said first and last branches to ground in order to precisely control coupling and a dual polarized antenna having dual inputs connected to said output and coupled ports wherein polarization impurities result from nonperfect feed systems.

8. The coupler of claim 7 in which said adjustable susceptances are reactively terminated transmission-line sections for producing a frequency sensitive coupler having exact control of either a positive or negative amplitude slope with frequency.

* * * * *